US005257197A

United States Patent [19]

Günther et al.

[11] Patent Number: 5,257,197

[45] Date of Patent: Oct. 26, 1993

[54] FRANKING MODULE

[75] Inventors: Stephan Günther; Werner Hesshaus, both of Berlin; Hanspeter Reichelt, Weilburg; Jürgen Volle, Dietzenbach; Hans-Peter Rogge, Berlin; Hans-Jürgen Hudetzka, Leonberg, all of Fed. Rep. of Germany

[73] Assignee: Francotyp-Postalia GmbH, Berlin, Fed. Rep. of Germany

[21] Appl. No.: 709,653

[22] Filed: Jun. 3, 1991

[30] Foreign Application Priority Data

Jun. 1, 1990 [DE] Fed. Rep. of Germany ..... 4018166

[51] Int. Cl.[5] ..... G07B 17/00

[52] U.S. Cl. ..... 364/464.02

[58] Field of Search ..... 364/464.02

[56] References Cited

U.S. PATENT DOCUMENTS

| | | | |
|---|---|---|---|
| 4,524,426 | 6/1985 | Eckert et al. | 364/464.02 |
| 4,628,476 | 12/1986 | Duwel | 364/464.02 |
| 4,858,138 | 8/1989 | Talmadge | 364/464.02 |
| 4,868,757 | 9/1989 | Gil | 364/464.02 X |
| 4,941,091 | 7/1990 | Breault et al. | 364/464.02 X |

*Primary Examiner*—Edward R. Cosimano

*Attorney, Agent, or Firm*—Herbert L. Lerner; Laurence A. Greenberg

[57] ABSTRACT

A personal computer has a housing, a drive bay in the housing with a slot for a disk drive, and an internal information and power supply network in the housing. A franking module assembly has a franking module disposed in the slot of the drive bay for franking mail. The franking module includes a printing mechanism, and a processor system for controlling the printing mechanism, for storing information to be printed and for accounting of charges. Lines in the housing connect the processor system to the internal information and power supply network.

14 Claims, 3 Drawing Sheets

Fig.1
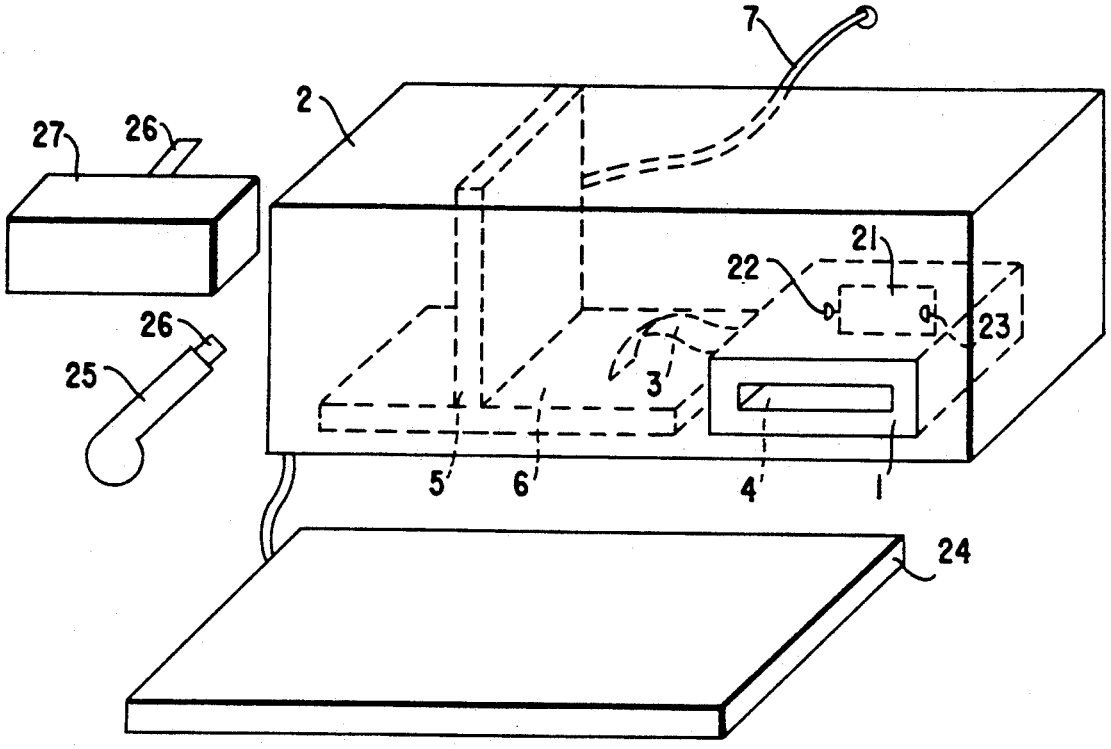
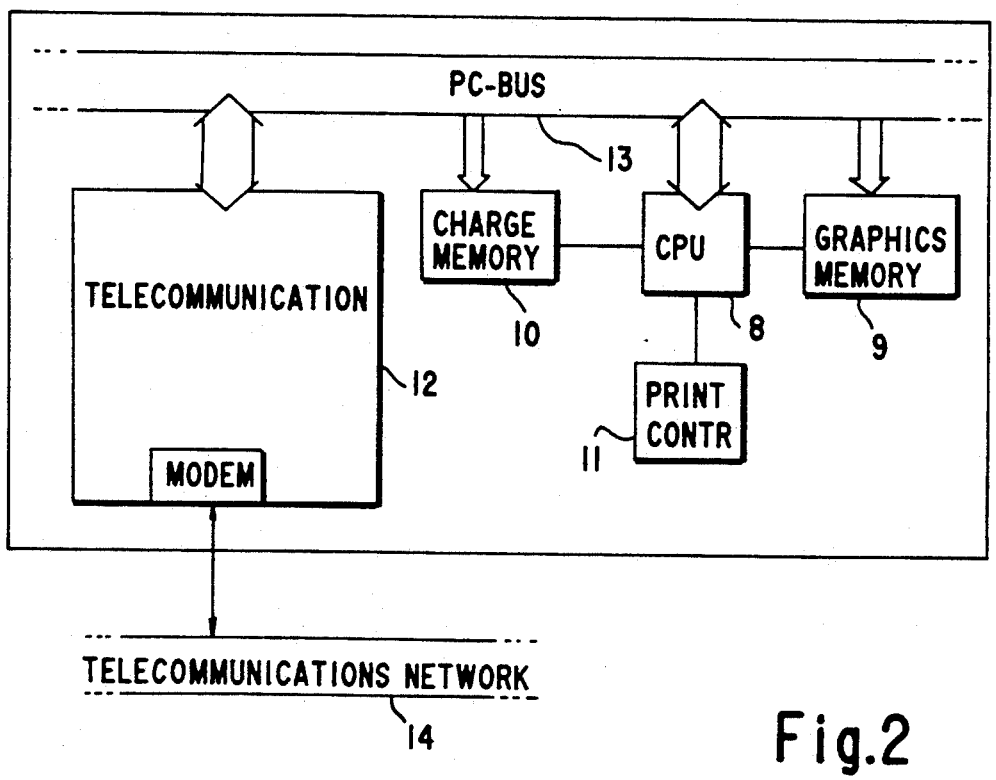
Fig.2

FRANKING MODULE

BACKGROUND OF THE INVENTION

1. Field of the Invention

The invention relates to a franking module for postal material, including a printing mechanism and a processor system for controlling the printing mechanism, for storing information to be printed, and for accounting of charges.

2. Description of the Related Art

Franking apparatuses are known. For instance, German Published, Non-Prosecuted Application DE 26 55 905 A1 describes a franking machine that uses a processor system to control franking processes and internal accounting, in which the operating memory and the register cooperate with an arithmetic unit through inputs from a keyboard. Such functional groups of a franking machine are disposed in a common housing with its own power supply, which includes not only a keyboard but also display means for charges that have been set and those that have been used. According to German Patent DE 29 12 696 C2), access to a higher-ranking supervisor over secure paths, for instance with the aid of a telecommunication network, is made possible for purposes of monitoring and accounting.

Such known franking machines are uneconomical for low quantities of mail, they require additional table space, and they necessitate relatively high initial costs.

SUMMARY OF THE INVENTION

It is accordingly an object of the invention to provide a franking module, which overcomes the hereinaforementioned disadvantages of the heretofore-known devices of this general type, which is simple to manipulate, which is suitable for wide use and in particular for users with a low mail volume, and which uses existing technical media owned by the user, especially the media of personal computer calculation and telecommunications, thus reducing expenses.

With the foregoing and other objects in view there is provided, in accordance with the invention, in a personal computer having a housing; a drive bay in the housing with a slot for a disk drive; and an internal information and power supply network in the housing, the improvement comprising a franking module assembly having a franking module disposed in the slot of the drive bay for franking mail, the franking module including printing mechanism, and a processor system for controlling the printing mechanism, for storing information to be printed and for accounting of charges; and lines in the housing for connecting the processor system to the internal information and power supply network.

In accordance with another feature of the invention, the franking module has a front with a slit-like opening formed therein being at least as wide as a standard letter, for receiving manually introduced mail.

In accordance with a further feature of the invention, the slit-like opening has an end, the franking module has a stop disposed at the end toward which the mail is guided, and the stop has measuring means for ascertaining arrival the mail at the stop and generating an enabling signal for a printing process.

In accordance with an added feature of the invention, the measuring means are in the form of a light barrier.

In accordance with an additional feature of the invention, the personal computer has an insertion site, and there is provided a telecommunications circuit disposed in the insertion site, the processor system including means for exchanging data for postal charge payment through the internal information and power supply network with the telecommunications circuit and for delivering the data to a higher-ranking payment office for performing remote postage rate setting and/or remote postage debiting of the postal charges.

In accordance with yet another feature of the invention, the telecommunications circuit is a PC fax board having a standard fax/modem.

In accordance with yet a further feature of the invention, the personal computer has a keyboard through which address data are input or a memory from which address data are read out, and delivered to the processor system through the internal information and power supply network.

In accordance with yet an added feature of the invention, the printing mechanism prints at least portions of the address data in the form of a bar code.

In accordance with yet an additional feature of the invention, the slit-like opening accepts self-adhesive franking strips for printing instead of the standard letters, in order to frank mail deviating from a standard size.

In accordance with again another feature of the invention, there is provided a manual insertion device for franking strips supplied individually from outside the franking module.

In accordance with again a further feature of the invention, there is provided a strip dispenser coupled to the franking module.

In accordance with a concomitant feature of the invention, the personal computer has a memory for storing graphical data of at least one advertising area, and the processor system has a graphic memory into which graphical data of a selected advertising area are loaded after selection by a user through the internal information and power supply network, and the graphic data previously stored in memory there are rewritten.

Other features which are considered as characteristic for the invention are set forth in the appended claims.

Although the invention is illustrated and described herein as embodied in a franking module, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 a diagrammatic front-perspective view of a typical personal computer (PC) housing, wherein the disposition of the franking module and its information-processing connection to the personal computer as well as an optional coupling to a remote postage transfer device are diagrammatically shown; whereas all of the other functional groups of the personal computer have been omitted for the sake of simplicity;

FIG. 2 a block circuit diagram of the processor system of the franking module including the most important functional units and its connection to the internal information network of the PC;

DESCRIPTION OF THE PREFERRED EMBODIMENT

Figure 3:
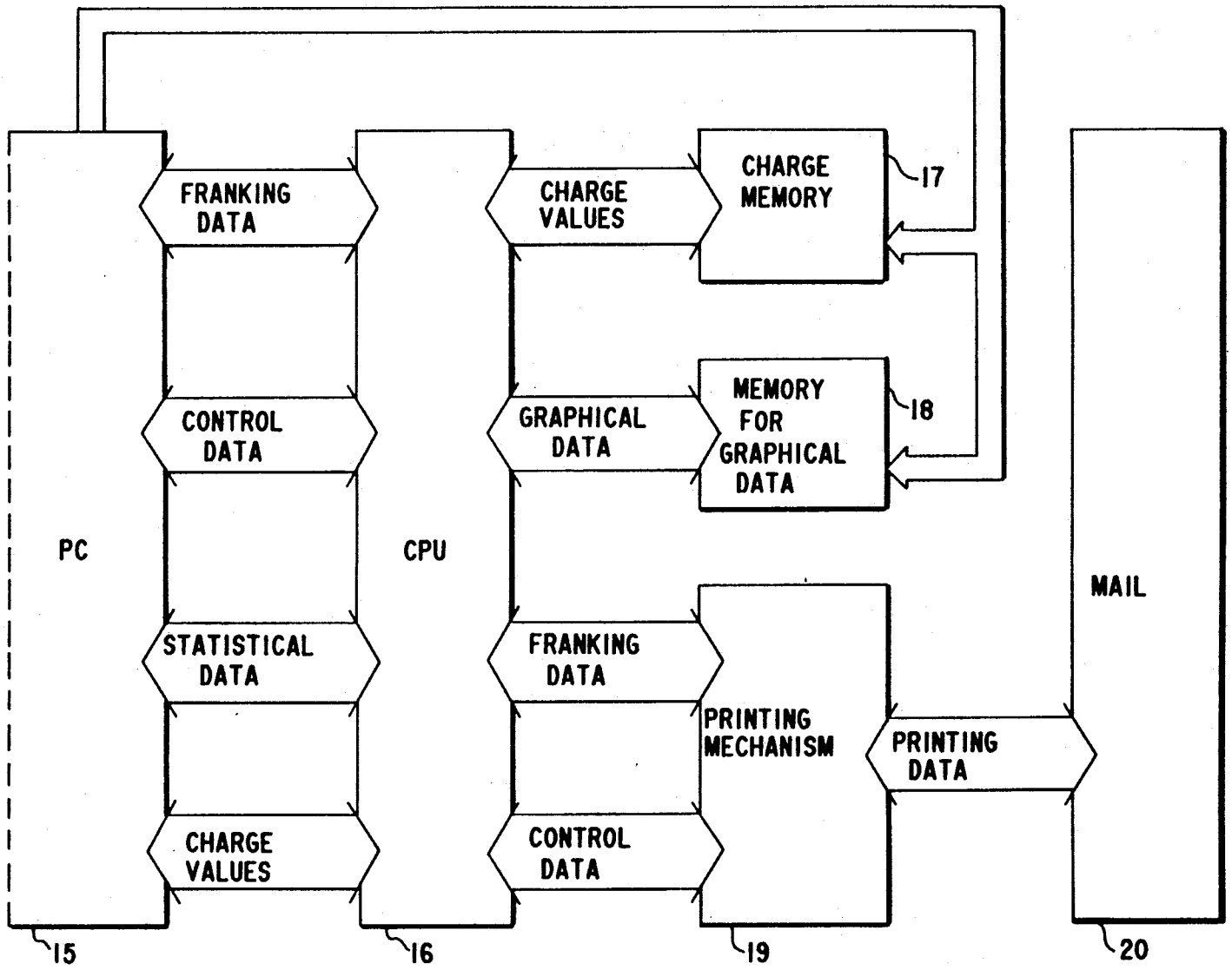
FIG. 3 is an information flow chart for the transfer of data relevant to franking between the most important functional groups, assuming that the structure of the PC is known and is therefore not shown.

In the drawings it is seen that procedures for data transfer between the processor system, the PC and the telecommunication network are not shown, because they can be performed in accordance with known standards.

The provisions according to the invention take into account the fact that a steadily increasing proportion of postal customers is equipped with computerized systems, in particular in the form of personal computers. Through the use of the invention, all of the main functions of the franking machine are fully integrated into a personal computer system, so that functional groups in such a system, such as the power supply, internal information network, keyboard and monitor are jointly used. The disposition of the franking module in a slot of a drive bay for a disk drive according to the invention avoids the occupation of additional space which is associated with the set-up of conventional franking machines.

Referring now to the figures of the drawing in detail and first, particularly, to FIG. 1 thereof, there is seen a franking module 1 having the dimensions of a disk drive of a personal computer. In order to process letters or envelopes of standard size and shape, the franking module has the dimensions of a 5¼ inch disk drive, and is installed instead of such a disk drive in a free slot of a drive bay on the front of a PC housing 2.

The franking module is equipped with an insertion slit 4 for letters. The letters are inserted in the longitudinal direction thereof, and the side of the letter to be printed is oriented toward a printing mechanism. In other words, for a printing mechanism that prints vertically downward, the letter is introduced with the side to be printed facing upward. A stop 21 is provided at the end of an insertion shaft, up to which the letters can be inserted. Arrival at the stop is detected by a light barrier 22, 23 installed at that location, whereupon a retaining device is activated that fixes the letter in that position for the duration of the printing process, and subsequently releases it so that it can be removed.

The personal computer is typically equipped with a keyboard 24 and a monitor. User information needed for franking is developed through these two peripherals. A franking program to be called up is advantageously based on a menu-oriented user guide.

The franking module includes a processor system. Besides a central processor unit 8 shown in FIG. 2, a non-illustrated non-volatile program memory and a non-illustrated volatile data memory, the processor system includes a non-volatile write charge memory 10, a write memory 9 for graphic data for printing advertising, and an electronic trigger system 11 for a printing mechanism. This processor system is connected to a system bus 13 of the PC through information lines 3 shown in FIG. 1 that are lead or guided in the housing of the PC. This connection may, for instance, be in the form of flexible data lines, which are carried on a plug connector for expansion circuits of a board 6, that in turn are connected to the system bus. Data are in turn transmitted from the PC system 13 through a telecommunications modem 12 to a telecommunications network 14, as seen in FIG. 2. There are also electrical connections for supplying power to the processor system from the power supply system of the PC.

A connection of the processor system of the franking module to a telecommunications circuit 5 installed in an expansion slot, can be made through the system bus of the PC. Such circuits are, for instance, used as PC fax boards, in order to be able to send information prepared by means of personal computers directly over telephone lines 7 to a receiver having a fax system. Circuits are also known that achieve other transmission protocols, in particular at high transmission rates. The remote postage transfer for the charge data to a higher-ranking payment office, or remote postage rate setting for a certain franking value, are possible through a direct connection between the franking module and a telecommunications circuit, as achieved by the provisions of the invention.

Address data which are input by the keyboard or called up from a memory of the PC can also be transferred to the processor system, and they are then prepared and finally printed. In a special variant embodiment, these address data or portions of this information are also printed in the form of a bar code on the envelope or on a postage strip 26, in order to enable automatic mail sorting.

Between a personal computer 15 and the processor system 16 of the franking module, which are seen in FIG. 3, the following groups of data are exchanged:

franking data (amount of postage, type of shipment, advertising area, address data, encoded data);

control data (feedback, error reports, time data);

statistical data (preset data, quantitative data, error data); and charge data in connection with remote postage rate setting.

The processor 16 in turn stores charge data in memory in a separate charge memory 17 and stores data for a current advertising field in a memory 18 for graphic data. Through the use of the latter process, it is possible to select the current advertising field from various advertising fields stored in the personal computer. A printing mechanism 19 receives franking data to be printed on mail 20 from the processor system and it acknowledges this receipt. It also exchanges relevant control data for the printing process.

According to a special variant embodiment, self-adhesive strips 26 can be printed for mail that differs from standard size. To this end, in a simple embodiment, an insertion device 25 that can be operated manually is provided for introducing individual strips into the franking module. According to another version, the franking module 1 is coupled to a strip dispenser 27, which automatically separates and delivers the strips 26.

Figure 4:
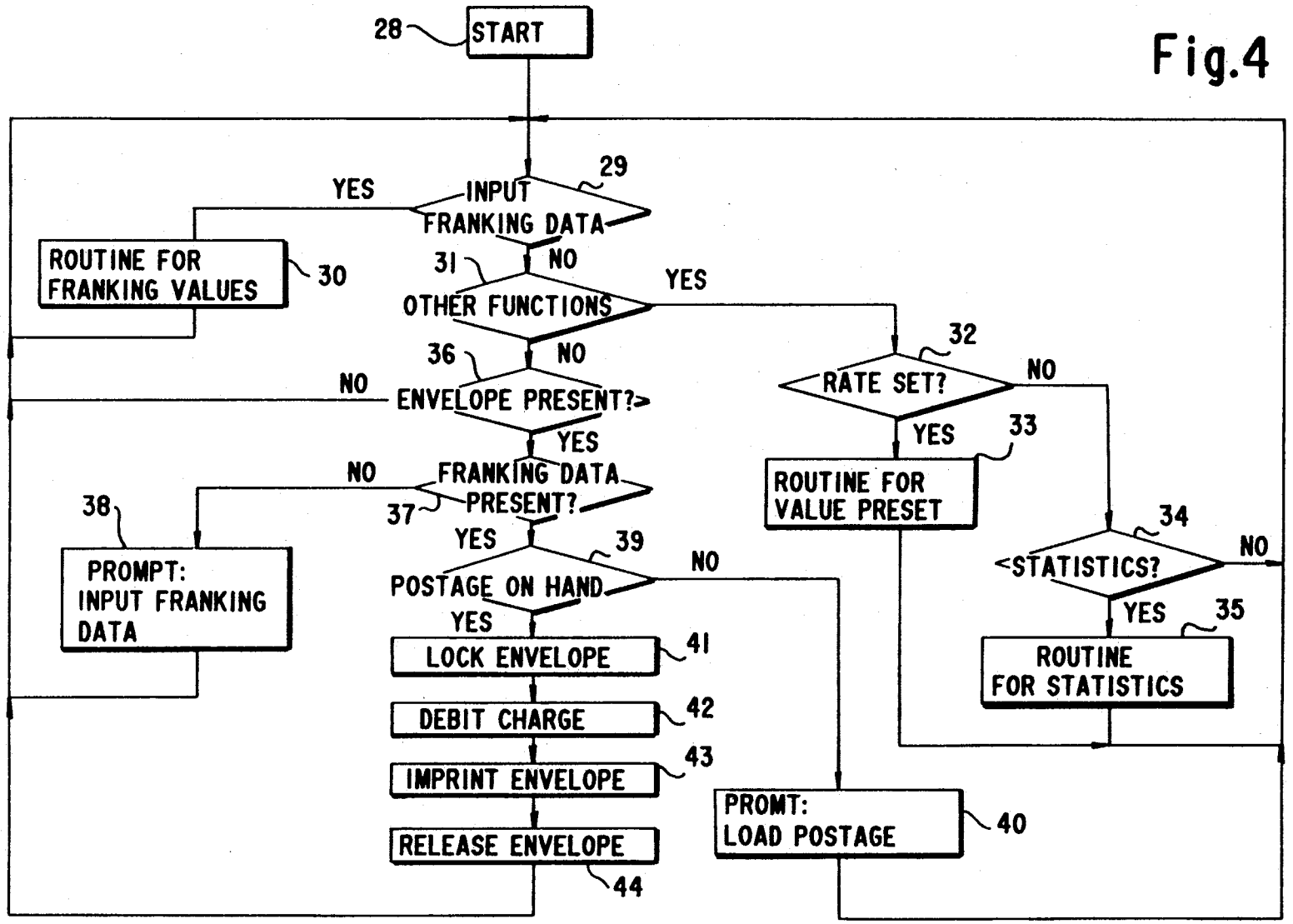
FIG. 4 is a flow chart of operating steps for user dialog, for calculating and paying charges, and for controlling the printing process.

The above-described process for printing mail with the illustrated apparatus is shown in the form of a flow chart in FIG. 4. According to the flow chart, when the system is started at 28 a command is given at 29 to input franking data. If the franking data are input, a routine for franking values 30 is begun, which leads to a command to start the system. If franking data are not input, a command is given 31 to begin other functions of the system.

If the other functions are begun, an inquiry is made at 32 as to whether or not a rate has been set. If a rate has been set, a routine for a preset value 33 is begun and a command is given to start the system.

If a rate has not been set, a determination is made at 34 as to whether or not statistics are present. If statistics are not present, a command is given to start the system. If statistics are present, a routine for the statistics 35 is begun, which also leads to a command to start the system.

If the other functions 31 are not begun, an inquiry is made at 36 as to whether or not an envelope or letter is present. If an envelope or letter is not present, a command is given to start the system.

If an envelope or letter is present, an inquiry is made at 37 as to whether or not franking data are present. If franking data are not present, a prompt is given at 38 to input franking data, which leads to a command to start the system.

If franking data are present, an inquiry is made at 39 as to whether or not postage is on hand. If postage is not on hand, a prompt is given at 40 to load postage, which leads to a command to start the system.

If postage is on hand, the envelope or letter is locked at 41 a debit charge is made at 42, the envelope or letter is imprinted at 43 and the envelope or letter is release at 44, which again leads to a command to start the system.

We claim:

1. In a personal computer having a housing; a drive bay in the housing with a slot for a disk drive; and an internal information and power supply network in the housing, the improvement comprising a franking module assembly having:

a franking module disposed in the slot of the drive bay for franking mail, said franking module including a printing mechanism, and a processor system for controlling said printing mechanism, for storing information to be printed and for accounting of charges; and lines in the housing connecting said processor system to the internal information and power supply network.

2. The franking module assembly according to claim 1, wherein the personal computer has a memory for storing graphical data of at least one advertising area, and said processor system has a graphic memory into which graphical data of a selected advertising area are loaded after selection by a user through said internal information and power supply network, and the graphic data previously stored in memory there are rewritten.

3. The franking module assembly according to claim 1, wherein the personal computer has an insertion site, and including a telecommunications circuit disposed in the insertion site, said processor system including means for exchanging data for postal charge payment through said internal information and power supply network with said telecommunications circuit and for delivering the data to a higher-ranking payment office for performing at least one of remote postage rate setting and remote postage debiting of the postal charges.

4. The franking module assembly according to claim 3, wherein said telecommunications circuit is a PC fax board having a standard fax/modem.

5. The franking module assembly according to claim 1, wherein the personal computer has a keyboard through which address data are input and delivered to said processor system through said internal information and power supply network.

6. The franking module assembly according to claim 5, wherein said printing mechanism prints at least portions of the address data in the form of a bar code.

7. The franking module assembly according to claim 1, wherein the personal computer has a memory from which address data are read out and delivered to said processor system through said internal information and power supply network.

8. The franking module assembly according to claim 7, wherein said printing mechanism prints at least portions of the address data in the form of a bar code.

9. The franking module assembly according to claim 1, wherein said franking module has a front with a slit-like opening formed therein being at least as wide as a standard letter, for receiving manually introduced mail.

10. The franking module assembly according to claim 9, wherein said slit-like opening has an end, said franking module has a stop disposed at said end toward which the mail is guided, and said stop has measuring means for ascertaining arrival the mail at said stop and generating an enabling signal for a printing process.

11. The franking module assembly according to claim 10, wherein said measuring means are in the form of a light barrier.

12. The franking module assembly according to claim 9, wherein said slit-like opening accepts self-adhesive franking strips for printing instead of the standard letters, in order to frank mail deviating from a standard size.

13. The franking module assembly according to claim 12, including manual insertion device for franking strips supplied individually from outside said franking module.

14. The franking module assembly according to claim 12, including a strip disperser coupled to said franking module.

* * * * *